US010760209B1

(12) United States Patent
Qiang et al.

(10) Patent No.: US 10,760,209 B1
(45) Date of Patent: Sep. 1, 2020

(54) METHOD FOR PREPARING HIGH FLUFFINESS DOWN BY MULTIPLE TREATMENTS WITH METAL SALTS

(71) Applicants: Taotao Qiang, Xi'an (CN); Yadong Pu, Xi'an (CN); Qi Zhang, Xi'an (CN)

(72) Inventors: Taotao Qiang, Xi'an (CN); Yadong Pu, Xi'an (CN); Qi Zhang, Xi'an (CN)

(73) Assignee: SHAANXI UNIVERSITY OF SCIENCE AND TECHNOLOGY, Xi'an (CN)

( * ) Notice: Subject to any disclaimer, the term of this patent is extended or adjusted under 35 U.S.C. 154(b) by 0 days.

(21) Appl. No.: 16/805,781

(22) Filed: Mar. 1, 2020

(30) Foreign Application Priority Data

Apr. 29, 2019 (CN) ..... 2019 1 0357569

(51) Int. Cl.
*D06M 19/00* (2006.01)

(52) U.S. Cl.
CPC ..... *D06M 19/00* (2013.01)

(58) Field of Classification Search
CPC ..... D06M 19/00
See application file for complete search history.

(56) References Cited

U.S. PATENT DOCUMENTS 2,886,399 A * 5/1959 Pasternak ..... D06M 19/00 8/94.1 R
5,073,304 A * 12/1991 Yamazaki ..... D06M 19/00 252/603
2003/0075289 A1* 4/2003 Stoltz ..... D06M 19/00 162/20

FOREIGN PATENT DOCUMENTS

CN 105002740 * 10/2015 ..... D06L 1/16

* cited by examiner

*Primary Examiner* — Amina S Khan

(57) ABSTRACT

A method for preparing a high fluffiness down by multiple treatments with metal salts includes: degreasing a down sample with a degreasing agent; washing the down sample with water; oxidizing the down sample with an oxidizing agent; washing the down sample with water; conducting a first crosslinking treatment with basic zirconium sulfate; washing the down sample with water; conducting a second crosslinking treatment with basic aluminum sulfate; washing the down sample with water; and drying the down sample to obtain the high fluffiness down.

5 Claims, 3 Drawing Sheets

METHOD FOR PREPARING HIGH FLUFFINESS DOWN BY MULTIPLE TREATMENTS WITH METAL SALTS

The present invention claims priority to Chinese patent application no.: 201910357569.6, field on Apr. 29, 2019, which is incorporated by reference for all purposes as if fully set forth herein.

FIELD OF THE INVENTION

The present invention relates to the technical field of down processing, specifically, a method for preparing high fluffiness down by multiple treatments with metal salts.

BACKGROUND OF THE INVENTION

Down is light, thin and soft. Down products have been widely used in daily life, such as down jackets and quilts. The feathers (down samples) obtained directly from animals do not have the fluffiness that is require for down products and must be treated to obtain the fluffiness. Therefore, finding an efficient and clean process to treat down samples is important.

Basic zirconium sulfate is widely used in down processing. The protein fiber treated with basic zirconium sulfate has a significant increase in elasticity because the zirconium complex forms a tetramer with a hydroxyl group of down sample as a bridge. The tetramer will be aggregated into a larger molecular weight and more complex zirconium complex. The zirconium complex will form hydrogen bonds with the active amino group of the down sample, which will increase the intermolecular bond of the down sample and fluffiness. Basic zirconium sulfate has limited supply and is expensive. Therefore, it is very necessary to develop a new down treatment method that is efficient, clean, and cost-effective.

SUMMARY OF THE INVENTION

In one embodiment, a method for preparing a high fluffiness down by multiple treatments with metal salts includes: degreasing a down sample with a degreasing agent; washing the down sample with water; oxidizing the down sample with an oxidizing agent; washing the down sample with water; conducting a first crosslinking treatment with basic zirconium sulfate; washing the down sample with water; conducting a second crosslinking treatment with basic aluminum sulfate; washing the down sample with water; and drying the down sample to obtain the high fluffiness down.

In another embodiment, degreasing the down sample with the degreasing agent includes: adding the down sample to water in a weight ratio of the down sample to water being 1:40-50; adding the degreasing agent to the down sample and water in a ratio of the degreasing agent to water being 1-2 g: 1 L; and conducting the degreasing at 40 to 45° C. for 60 to 70 min.

In another embodiment, the degreasing agent is a cationic surfactant, an anionic surfactant, a nonionic surfactant, a mixture of the cationic surfactant and the nonionic surfactant, or a mixture of the anionic surfactant and the nonionic surfactant.

In another embodiment, oxidizing the down sample with the oxidizing agent includes: adding the down sample to water in a weight ratio of the down sample and water being 1:30-35; adding the oxidizing agent to the down sample and water in a ratio of the oxidizing agent to water being 0.8-1 g: 1 L; and conducing the oxidization at 25 to 30° C. for 30 to 40 min.

In another embodiment, the oxidizing agent is hydrogen peroxide or sodium hypochlorite.

In another embodiment, conducting the first crosslinking treatment with basic zirconium sulfate includes: adding the down sample to water in a weight ratio of the down sample to water being 1:25-30 to obtain a first mixture system; adding a first organic acid to the first mixture system to pH of 3-3.5; adding basic zirconium sulfate in portions in a ratio of basic zirconium sulfate to water being 2-4 g: 1 L; and conducting the first crosslinking treatment at 30 to 50° C. for 30 to 90 min.

In another embodiment, the first organic acid is fruit acid, acetic acid, or lactic acid.

In another embodiment, conducting the second crosslinking treatment with basic aluminum sulfate includes: adding the down sample to water in a weight ratio of the down sample to water being 1:25-30 to obtain a second mixture system; adding a second organic acid to the second mixture system to pH of 3.5-4.5; adding basic aluminum sulfate in portions in a ratio of basic zirconium sulfate to water being 1-2 g: 1 L; and conducting the first crosslinking treatment at 30 to 50° C. for 90-120 min.

In another embodiment, the second organic acid is oxalic acid, acetic acid or lactic acid.

Compared with conventional methods, the present invention has the following advantages:

After the down sample has been degreased and oxidized, the impurities and grease on the down sample surface have been completely removed, and the active groups on the down sample have been fully exposed. After treatments of basic zirconium sulfate and basic aluminum sulfate, the active groups of the down sample and the metal salts are fully cross-linked, so that the molecular binding force of the down sample is increased, leading to softness and fluffiness. In addition, the use of basic aluminum sulfate not only improves the fluffiness of down, but also reduces the processing cost and improves efficiency.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Figure 1:
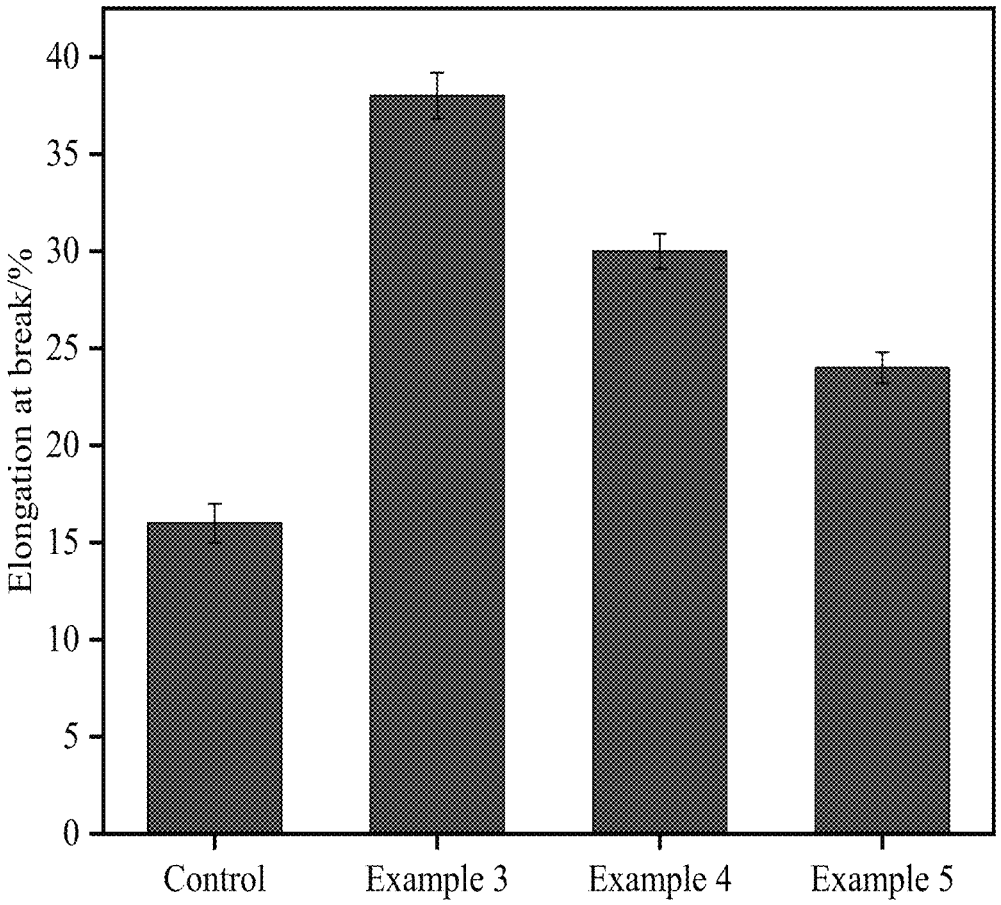
FIG. 1 is a diagram of the elongation at break % of the down samples of Examples 3 to 5.

Reference will now be made in detail to embodiments of the present invention, example of which is illustrated in the accompanying drawings.

The experimental methods and detection methods described in the following examples are conventional methods unless otherwise specified. The reagents and materials, unless otherwise specified, are commercially available.

Basic zirconium sulfate (zirconium (IV) sulfate) is the name for a family of inorganic compounds with the formula $Zr(SO_4)_2(H_2O)_n$ where n=0, 4, 5, 7. Basic aluminum sulfate (aluminum sulfate) is a chemical compound with the formula $Al_2(SO_4)_3$.

Example 1

A method for preparing a high fluffiness down by multiple treatments with metal salts includes the following steps:

Down sample, water and a degreaser (Liannuo Chemical LQ-5) were added into a washing machine. The weight ratio of down sample to water is 1:40. 2 g of LQ-5 degreaser was added to one liter of water. The down sample was degreased at 40° C. for 70 min. After the degreasing was completed, the sample was washed with warm water three times. Water and hydrogen peroxide were added to the down sample in the washing machine. The weight ratio of the down sample to the water is 1:30, and 1 g of hydrogen peroxide was added to one liter of water. The down sample was oxidized at 25° C. for 40 min. After oxidation was completed, the down sample was washed with warm water three times. Water was added to the down sample to form a first mixture system. The weight ratio of the down sample to water to 1:25. Fruit acid was added to the first mixture system to adjust the pH of the system to 3. Basic zirconium sulfate solution (1.0 g in one liter of water) was added to the first mixture system in three portions to conduct crosslinking at 45° C. for 30 min. After the crosslinking is completed, the down sample was washed with water. Water was added to the down sample to form a second mixture system. The weight ratio of the down sample to water to 1:25. Oxalic acid was added to the second mixture system to adjust the pH of the system to 3.5. Basic aluminum sulfate solution (3.0 g in one liter of water) was added to the first mixture system in three portions to conduct crosslinking at 40° C. for 90 min. After the crosslinking is completed, the down sample was washed with warm water three times, and dried to obtain a high fluffiness down.

Example 2

A method for preparing a high fluffiness down by multiple treatments with metal salts includes the following steps:

Down sample, water and a degreaser (Liannuo Chemical LQ-5) were added into a washing machine. The weight ratio of down sample to water is 1:50. 1.5 g of LQ-5 degreaser was added to one liter of water. The down sample was degreased at 40° C. for 65 min. After the degreasing was completed, the sample was washed with warm water three times. Water and hydrogen peroxide were added to the down sample in the washing machine. The weight ratio of the down sample to the water is 1:30, and 1 g of sodium hypochlorite was added to one liter of water. The down sample was oxidized at 30° C. for 40 min. After oxidation was completed, the down sample was washed with warm water three times. Water was added to the down sample to form a first mixture system. The weight ratio of the down sample to water to 1:30. Acetic acid was added to the first mixture system to adjust the pH of the system to 3.5. Basic zirconium sulfate solution (2.0 g in one liter of water) was added to the first mixture system in three portions to conduct crosslinking at 40° C. for 60 min. After the crosslinking is completed, the down sample was washed with water. Water was added to the down sample to form a second mixture system. The weight ratio of the down sample to water to 1:25. Acetic acid was added to the second mixture system to adjust the pH of the system to 3.5. Basic aluminum sulfate solution (2.0 g in one liter of water) was added to the first mixture system in three portions to conduct crosslinking at 35° C. for 90 min. After the crosslinking is completed, the down sample was washed with warm water three times, and dried to obtain a high fluffiness down.

Example 3

A method for preparing a high fluffiness down by multiple treatments with metal salts includes the following steps:

Down sample, water and a degreaser (Liannuo Chemical LQ-5) were added into a washing machine. The weight ratio of down sample to water is 1:45. 1.5 g of LQ-5 degreaser was added to one liter of water. The down sample was degreased at 40° C. for 65 min. After the degreasing was completed, the sample was washed with warm water three times. Water and hydrogen peroxide were added to the down sample in the washing machine. The weight ratio of the down sample to the water is 1:30, and 1 g of hydrogen peroxide was added to one liter of water. The down sample was oxidized at 30° C. for 40 min. After oxidation was completed, the down sample was washed with warm water three times. Water was added to the down sample to form a first mixture system. The weight ratio of the down sample to water to 1:30. Fruit acid was added to the first mixture system to adjust the pH of the system to 3.5. Basic zirconium sulfate solution (3.0 g in one liter of water) was added to the first mixture system in three portions to conduct crosslinking at 30° C. for 60 min. After the crosslinking is completed, the down sample was washed with water. Water was added to the down sample to form a second mixture system. The weight ratio of the down sample to water to 1:30. Oxalic acid was added to the second mixture system to adjust the pH of the system to 4. Basic aluminum sulfate solution (1.0 g in one liter of water) was added to the first mixture system in three portions to conduct crosslinking at 30° C. for 90 min. After the crosslinking is completed, the down sample was washed with warm water three times, and dried to obtain a high fluffiness down.

Example 4

A method for preparing a high fluffiness down by multiple treatments with metal salts includes the following steps:

Down sample, water and a degreaser (Liannuo Chemical LQ-5) were added into a washing machine. The weight ratio of down sample to water is 1:50. 2 g of LQ-5 degreaser was added to one liter of water. The down sample was degreased at 45° C. for 70 min. After the degreasing was completed, the sample was washed with warm water three times. Water and hydrogen peroxide were added to the down sample in the washing machine. The weight ratio of the down sample to the water is 1:35, and 1 g of hydrogen peroxide was added to one liter of water. The down sample was oxidized at 30° C. for 40 min. After oxidation was completed, the down sample was washed with warm water three times. Water was added to the down sample to form a first mixture system. The weight ratio of the down sample to water to 1:30. Fruit acid was added to the first mixture system to adjust the pH of the system to 3.5. Basic zirconium sulfate solution (4.0 g in one liter of water) was added to the first mixture system in three portions to conduct crosslinking at 50° C. for 90 min. After the crosslinking is completed, the down sample was washed with warm water three times, and dried to obtain a high fluffiness down.

Example 5

A method for preparing a high fluffiness down by multiple treatments with metal salts includes the following steps:

Down sample, water and a degreaser (Liannuo Chemical LQ-5) were added into a washing machine. The weight ratio of down sample to water is 1:50. 2 g of LQ-5 degreaser was added to one liter of water. The down sample was degreased at 45° C. for 70 min. After the degreasing was completed, the sample was washed with warm water three times. Water and hydrogen peroxide were added to the down sample in the washing machine. The weight ratio of the down sample to the water is 1:35, and 1 g of hydrogen peroxide was added to one liter of water. The down sample was oxidized at 30° C. for 40 min. After oxidation was completed, the down sample was washed with warm water three times. Water was added to the down sample to form a first mixture system. The weight ratio of the down sample to water to 1:30. Acetic acid was added to the first mixture system to adjust the pH of the system to 4.5. Basic aluminum sulfate solution (4.0 g in one liter of water) was added to the first mixture system in three portions to conduct crosslinking at 50° C. for 90 min. After the crosslinking is completed, the down sample was washed with warm water three times, and dried to obtain a high fluffiness down.

The fluffiness tests were conducted for the downs obtained in Examples 1 to 5. The results are shown in Table 1. The fluffiness tests measure the volume of the down per gram of down ($cm^3/g$).

TABLE 1

Increase in Fluffiness After Metal Salt Treatment

| Samples | Fluffiness Before Treatment ($cm^3/g$) | Fluffiness After Treatment ($cm^3/g$) | Increase (%) |
|---|---|---|---|
| Example 1 | 15 | 17.3 | 15.3 |
| Example 2 | 15 | 18.6 | 24.0 |
| Example 3 | 15 | 19.2 | 28.0 |
| Example 4 | 15 | 17.7 | 18.0 |
| Example 5 | 15 | 17.2 | 14.7 |

As shown in Table 1, the combination of basic zirconium sulfate and basic aluminum sulfate (examples 1-3) will lead equal or better fluffiness when compared with basic zirconium sulfate alone (Example 4) or basic aluminum sulfate alone (example 5). The synergistic use with the combination of basic zirconium sulfate and basic aluminum sulfate not only improves the fluffiness of down, but also reduces the processing cost.

In addition, elongation at break %, XRD (X-Ray Diffraction) patterns, and Differential Scanning calorimetry (DSC) of the down samples of Control (no treatment) and Examples 3 to 5 were measured.

As shown in FIG. 1, the down with two crosslinking treatments (Example 3) has longer elongation at break % than downs with no crosslinking treatment (Control) and one crosslinking treatment (Examples 4-5). This is because the binding force between the down molecules is enhanced after two crosslinking treatments. Macroscopically, the elasticity of the down fibers is enhanced, the elongation at break is increased, and the fluffiness of the down is eventually improved.

Figure 2:
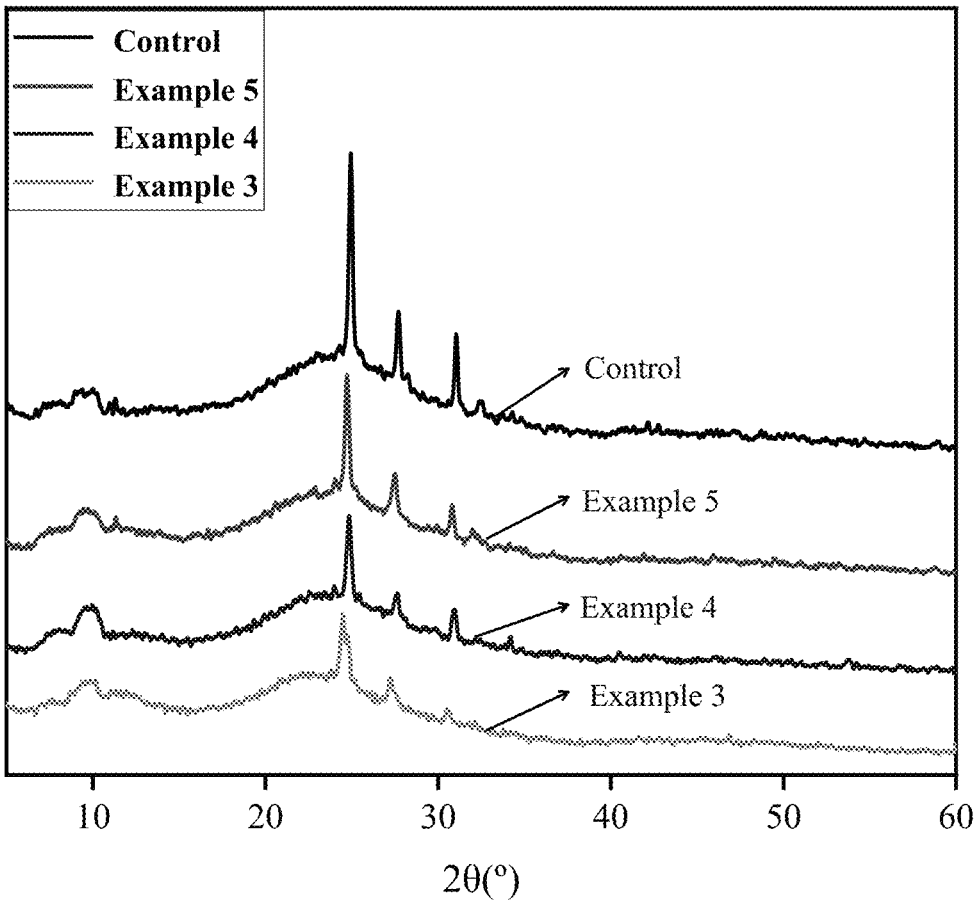
FIG. 2 shows XRD (X-Ray Diffraction) patterns the down samples of Examples 3 to 5.

As shown in FIG. 2, the crystallinity of the down after the two treatments (Example 3) is reduced. This is because the down molecules are arranged from orderly to disorderly after the crosslinking treatments.

Figure 3:
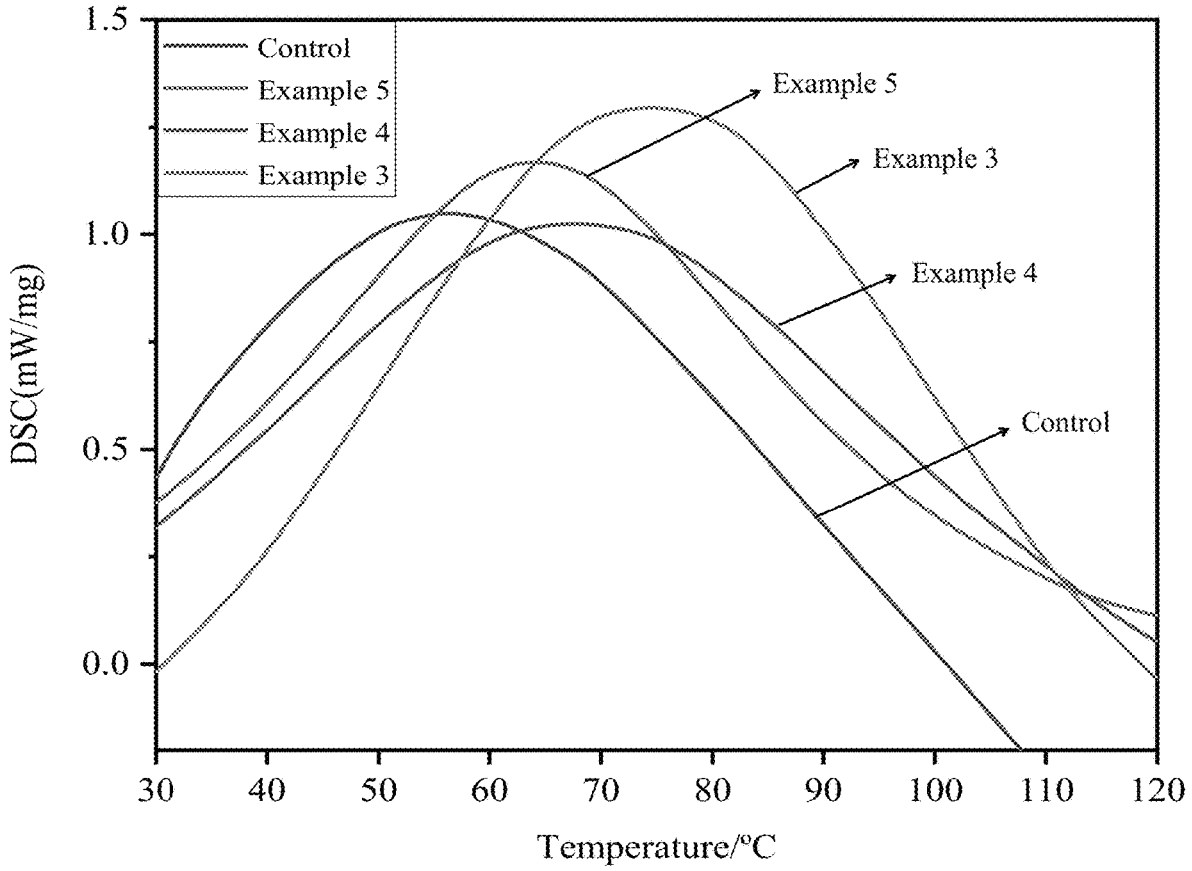
FIG. 3 shows Differential Scanning calorimetry (DSC) of the down samples of Examples 3 to 5.

As shown in FIG. 3, the thermal stability of the down is improved after two crosslinking treatments (Example 3). This is because the crosslinking treatments enhance the binding force between the down fiber molecules. The enhancement of the thermal stability is of great significance to the improvement of the down quality.

In summary, multiple treatments of down sample with metal salts (crosslinking agents) increases the fluffiness of down and improving the quality of down.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method for preparing a high fluffiness down by multiple treatments with metal salts consisting of the following steps in a sequential order:

degreasing a down sample with a degreasing agent;

washing the down sample with water;

oxidizing the down sample with an oxidizing agent;

washing the down sample with water;

conducting a first crosslinking treatment with basic zirconium sulfate;

washing the down sample with water;

conducting a second crosslinking treatment with basic aluminum sulfate;

washing the down sample with water; and drying the down sample to obtain the high fluffiness down, wherein degreasing the down sample with the degreasing agent is performed by:

adding the down sample to water in a weight ratio of the down sample to water being 1:40-50;

adding the degreasing agent to the down sample and water in a ratio of the degreasing agent to water being 1-2 g:1 L; and conducting the degreasing at 40 to 45° C. for 60 to 70 min, wherein oxidizing the down sample with the oxidizing agent is performed by:

adding the down sample to water in a weight ratio of the down sample and water being 1:30-35;

adding the oxidizing agent to the down sample and water in a ratio of the oxidizing agent to water being 0.8-1 g:1 L; and conducing the oxidization at 25 to 30° C. for 30 to 40 min, wherein conducting the first crosslinking treatment with basic zirconium sulfate is performed by:

adding the down sample to water in a weight ratio of the down sample to water being 1:25-30 to obtain a first mixture system;

adding a first organic acid to the first mixture system to pH of 3-3.5;

adding basic zirconium sulfate in portions in a ratio of basic zirconium sulfate to water being 2-4 g:1 L; and conducting the first crosslinking treatment at 30 to 50° C. for 30 to 90 min, and wherein conducting the second crosslinking treatment with basic aluminum sulfate is performed by:

adding the down sample to water in a weight ratio of the down sample to water being 1:25-30 to obtain a second mixture system;

adding a second organic acid to the second mixture system to pH of 3.5-4.5;

adding basic aluminum sulfate in portions in a ratio of basic zirconium sulfate to water being 1-2 g:1 L; and conducting the first crosslinking treatment at 30 to 50° C. for 90-120 min.

2. The method of claim 1, wherein the degreasing agent is a cationic surfactant, an anionic surfactant, a nonionic surfactant, a mixture of the cationic surfactant and the nonionic surfactant, or a mixture of the anionic surfactant and the nonionic surfactant.

3. The method of claim 1, wherein the oxidizing agent is hydrogen peroxide or sodium hypochlorite.

4. The method of claim 1, wherein the first organic acid is fruit acid, acetic acid, or lactic acid.

5. The method of claim 1, wherein the second organic acid is oxalic acid, acetic acid or lactic acid.

* * * * *